US005088953A

United States Patent [19]

Richman

[11] Patent Number: 5,088,953

[45] Date of Patent: Feb. 18, 1992

[54] GRAVITY ACTIVATED WALKING TOY

[76] Inventor: Robert Richman, 2625 S. Atlantic Ave., 8 N. E., Daytona Beach, Fla. 32118

[21] Appl. No.: 639,346

[22] Filed: Jan. 10, 1991

[51] Int. Cl.[5] ..... A63H 13/00; A63H 15/02

[52] U.S. Cl. ..... 446/351; 446/316

[58] Field of Search ..... 446/316, 315, 314, 351, 446/352, 353, 354, 355, 356, 376, 377, 283, 284, 285, 286, 288, 296, 304

[56] References Cited

U.S. PATENT DOCUMENTS 4,386,479 6/1983 Terzian et al. ..... 446/351 X
4,824,415 4/1989 Herbstler et al. ..... 446/355 X

FOREIGN PATENT DOCUMENTS 549077 11/1957 Canada ..... 446/355
614815 6/1935 Fed. Rep. of Germany ..... 446/354
723980 4/1932 France ..... 446/304
843637 4/1939 France ..... 446/377
1058634 3/1954 France ..... 446/351
495167 8/1955 Italy ..... 446/351

OTHER PUBLICATIONS 433 730 11-11 France Société commandite 446-376.
904040 10-45 France Memelsdorff 446-316.

*Primary Examiner*—Robert A. Hafer

[57] ABSTRACT

A gravity activated walking toy on an elevated flat horizontal surface is provided wherein the walking movement is actuated by a weighted cord hanging from the toy over the edge of the elevated flat horizontal surface. When the angle of the cord hanging therefrom is changed to a vertical position the toy will stop walking when it reaches the edge so that it will not fall off.

6 Claims, 1 Drawing Sheet

GRAVITY ACTIVATED WALKING TOY

CROSS REFERENCE TO RELATED APPLICATIONS 4,018,002 4/1977 Holden
4,795,395 1/1989 Oishi et al.
4,816,002 3/1989 Brodrib
4,840,242 6/1989 Chih et al.
4,906,012 3/1990 Wang
3,610,620 10/1971 Stein
3,738,055 6/1973 Marble
4,180,940 1/1980 McMasters

STATEMENTS AS TO RIGHTS TO INVENTIONS MADE UNDER FEDERALLY SPONSORED RESEARCH AND DEVELOPMENT

No such rights exist

BACKGROUND OF THE INVENTION

1. Field of the Invention

This invention relates generally to toys and more specifically it relates to a gravity activated walking toy.

2. Description of Prior Art

In order to provide background information so that the invention may be completely understood and appreciated in its proper context, reference may be made to a number of prior art patents as follows:

U.S. Pat. Nos. 4,018,002, 4,795,395, 4,816,002, 4,840,242 and 4,906,012 which deal with various methods of imparting motion to animal toys, and U.S. Pat. Nos. 3,610,620, 3,738,055 and 4,180,940 which deal specifically with gravity actuated toys.

U.S. Pat. No. 4,018,002 discloses a spring driven toy walking animal which ambulates on wheels and possesses legs attached to said wheels. To operate the toy one would wind up a mechanical spring contained in the toy and then let the toy roll on its wheels along a flat surface.

U.S. Pat. No. 4,795,395 describes a toy animal that is actuated by a motor that has the capability of making sounds appropriate for the type of animal the toy represents.

U.S. Pat. No. 4,816,002 teaches a quadrupedal animal toy with a flexible spine capable of a modified "inchworm" motion when pulled by a leash held by the person engaged in playing with the toy.

U.S. Pat. No. 4,840,242 discloses a quadrupedal animal toy driven by a battery powered motor. The toy is meant for riding by a child, and the head, legs or wheels, and tail of the animal are detachable and can be reassembled by the child.

U.S. Pat. No. 4,906,012 is similar to U.S. Pat. No. 4,840,242 described above in that the disclosure describes a quadrupedal animal suitable to be riden by the individual engaged in playing with the toy, and is diferent in that U.S. Pat. No. 4,906,012 defines the toy's means of propulsion as being pedal power generated by the rider.

All the above referenced patents teach toy animals that are powered by a mechanical spring motor, an electric motor or by the individual engaged in playing with the toy. The disadvantages associated with the above energy sources include the need to wind a spring driven motor (and failure of same, rendering the toy inoperative), the need to replace batteries for electric motors (with the attendant cost), and operator fatigue.

The above means of propulsion are complex and therefore costly.

The present invention avoids the above problems by using an inexaustible energy source—gravity—and achieves high reliability and low cost simultaneously due to design simplicity U.S. Pat. No. 3,610,620 describes an abacus like device comprising beads riding on vertically oriented rods. The beads start out at the top of the rods and then slide down the rods. This having been accomplished, the child turns the toy upside down and the beads once again slide down the rods.

U.S. Pat No. 3,738,055 discloses a doll whose eyes and mouth are moved via a gravity pendulum, causing the doll to change its facial expression.

U.S. Pat. No. 4,180,940 reveals a helical spring attached at each end to a paddle. A small car rides on rollers down the spring when the spring longitudinal axis is vertically oriented.

As can be readily seen from the above 3 patents dealing with gravity actuation in toys none address actuating a toy animal using gravity.

Whatever the precise merits, features and advantages of the above cited references, none of them achieves or fulfills the purposes of the present invention.

SUMMARY OF THE INVENTION

A primary object of the present invention is to provide a gravity actuated walking toy that will overcome the shortcomings of the prior art devices.

Another object is to provide a gravity actuated walking toy which when placed onto an elevated flat horizontal surface will move thereacross until it reaches the edge and stops so that it will not fall off.

An additional object is to provide a gravity actuated walking toy in which the walking movement is activated by a weighted cord hanging over the edge of the elevated flat horizontal surface which when the angle of the cord hanging therefrom is changed into a vertical position the toy will stop walking.

A further object is to provide a gravity activated toy that is simple and easy to use.

A still further object is to provide a gravity activated toy that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
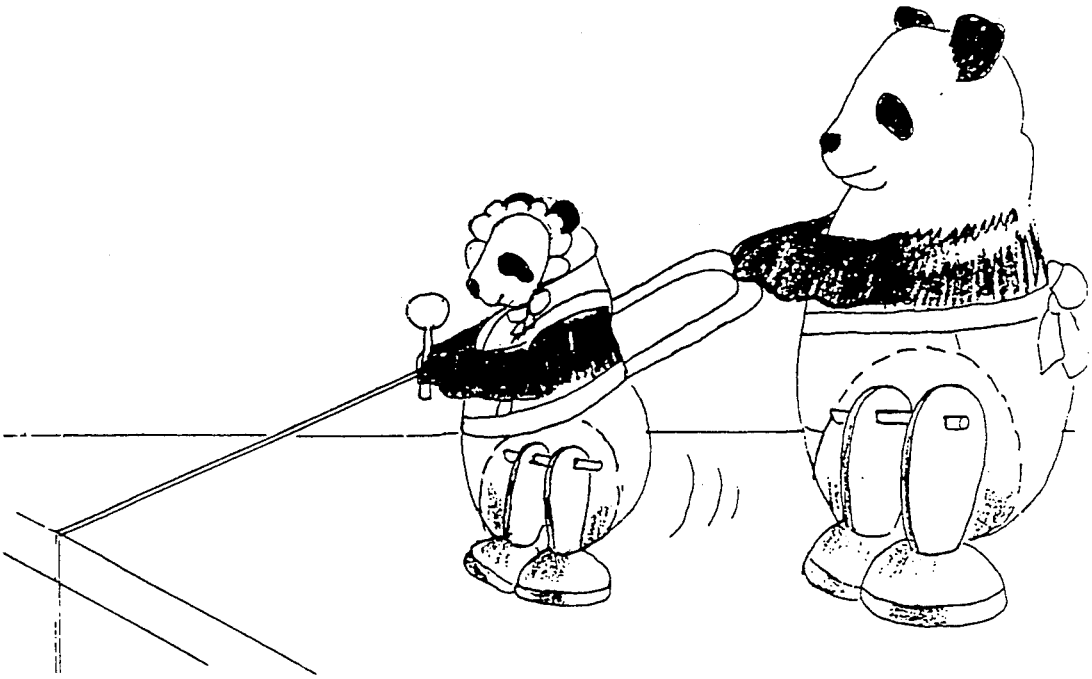
FIG. 1 is a perspective view of the instant invention positioned on a table showing in dotted lines how the weighted cord causes the walking movement up to the edge of the table.
Figure 2:
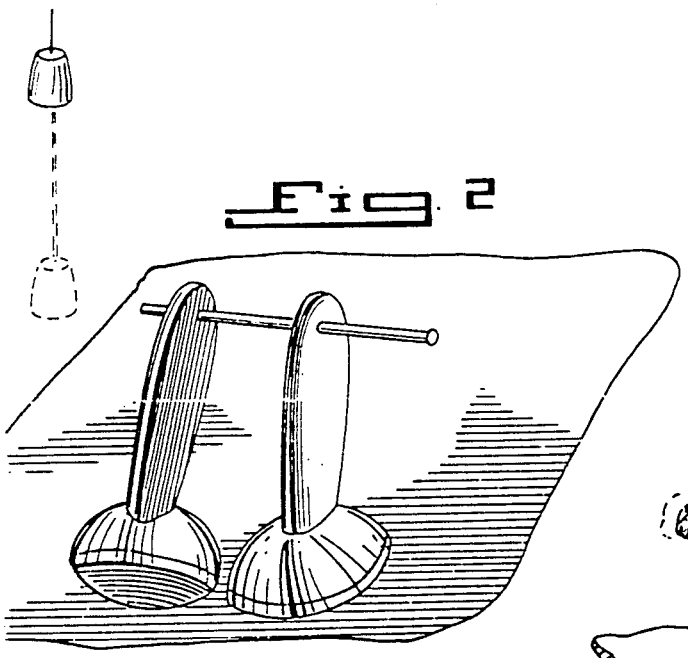
FIG. 2 is an enlarged perspective view of the first walking assembly unit on the table as indicated by the arrow 2 in FIG. 1.
Figure 3:
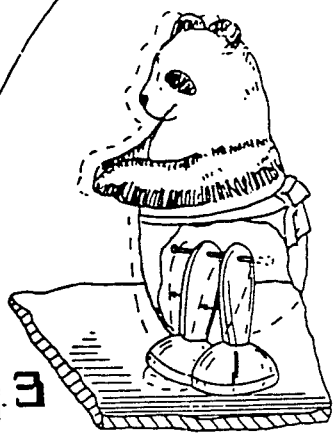
FIG. 3 is a perspective view of a portion of the instant invention with parts broken away o the table showing the movement of the second assembly unit in dotted lines.

Turning now descriptively to the drawings, in which similiar reference characters denote similiar elements throughout the several views, the Figures illustrate a gravity actuated walking toy 10 on an elevated flat horizontal surface 12 consisting of a simulated baby carriage 14 having a handle 16 with a simulated baby animal 18 sitting in an upright position therein drinking from a baby bottle 20 held in a horizontal position by the hands 22 of the baby animal 18. A simulated adult animal 24, standing in an upright position is behind the simulated baby carriage 14 holding onto the handle 16. A first walking assembly unit 26 is carried in the simulated baby carriage 14, while a second walking unit 28 is carried in the simulated adult animal 24. An elongated cord 30 is affixed at one end 32 to the baby bottle 20 so that the cord 30 will hang over one edge 34 of the elevated flat horizontal surface 12. A weight 36 affixed to another end 38 of the cord to be pulled by gravity, causing the first walking assembly unit 26 and the second walking assembly unit 28 to move the toy 10 across the elevated flat horizontal surface 12, until the edge 34 of the elevated flat horizontal surface 12 is reached in which the angle of the cord 30 will be changed into a vertical position stopping the walking movement of the toy 10.

The first walking assembly unit 26 includes a horizontal shaft 40 affixed at each end within the underside 42 of the simulated baby carriage 14. A first leg member 44 is pivotally attached at its upper end 46 to the horizontal shaft 40. A second leg member 48 is pivotally attached at its upper end 50 to the horizontal shaft 40 and is spaced away from the first leg member 44. A first foot member 52 is attached to the bottom end 54 of the first leg member 44 while a second foot member 56 is attached to the bottom end 58 of the second leg member 48.

The second walking assembly unit 28 includes a horizontal shaft 60 affixed at each end within the body 62 of the simulated adult animal 24. A first leg member 64 is pivotally attached at its upper end 66 to the horizontal shaft 60. A second leg member 68 is pivotally attached at its upper end 70 to the horizontal shaft 60 and is spaced away from the first leg member 64, while the second foot member 76 is attached to the bottom end 78 of the second leg member 68.

The simulated baby animal 18 is a baby panda 80 wearing a bonnet 82 on its head 84. The simulated adult animal 24 is a female panda 86 wearing apron 88 about its body 62. The elevated flat horizontal surface 12 is a top 90 of the table 92 supported by vertical legs 94.

The simulated baby carriage 14, the baby panda 80, the female panda 86, the first walking assembly unit 26 and the second walking assembly unit 28 can all be fabricated out of a durable material, such as metal, plastic, wood and the like. The elongated cord 30 can be made out of a flexible material, such as nylon or the like, while the weight 36 can be made out of a heavy material, such as lead, iron, weighted plastic or the like.

To use and play with the gravity activated walking toy 10, a person such as a child, can place it on the table top 90 and let the cord 30 hang over the edge 34. When the weight 36 is released it will pull on the cord 30 causing the first walking assembly unit 26 and the second walking assembly unit 28 to move their respective legs and feet in a walking movement across the table top 90. When the angle of the cord 30 changes into a vertical position it will stop the toy 10 at the edge 34 preventing it from falling off. To use the toy 10 again simply move it back away from the edge 34 and then release the weight 36 to start the walking movement again.

LIST OF REFERENCE NUMBERS

10 gravity actuated walking toy
12 elevated flat horizontal surface
14 simulated baby carriage
16 handle on 14
18 simulated baby animal in 14
20 baby bottle
22 hand of 18
24 simulated adult animal
26 first walking assembly unit
28 second walking assembly unit
30 elongated cord
32 one end of 30
34 one edge of 12
36 weight
38 other end of 30
40 horizontal shaft of 26
42 underside of 14
44 first leg member of 26
46 upper end of 44
48 second leg member of 26
50 upper end of 48
52 first foot member of 26
54 bottom end of 44
56 second foot member of 26
58 bottom end of 48
60 horizontal shaft of 28
62 body of 24
64 first leg member of 28
66 upper end of 64
68 second leg member of 28
70 upper end of 68
72 first foot member of 28
74 bottom end of 64
76 second foot member 28
78 bottom end of 68
80 baby panda for 18
82 bonnet
84 head of 80
86 female panda for 24
88 apron on 62
90 top for 12
92 table
94 leg of 92

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A gravity actuated walking toy for use on an elevated flat horizontal surface comprising:

a) at least one simulated animal and an object comprising a walking unit, said walking unit further comprising a smaller animal with arms holding onto an element and b) an elongated cord affixed at one end to said waling unit at said element so that the cord will hang over one edge of said elevated flat horizontal surface, and c) said object comprising a simulated conveyance with a walking assembly contained therein, said walking assembly comprising a horizontal shaft with a pair of depending legs, the legs in contact with the surface thereby supporting the simulated conveyance, the object connected to the simulated animal so that the animal appears to be pushing the object, d) a weight affixed to another end of said elongated cord to be pulled by gravity, causing said walking unit to move said toy across said elevated flat horizontal surface, until an edge of said elevated flat horizontal surface is reached, in which case the angle of said cord will be changed from a generally horizontal angle into a generally vertical angle stopping the walking movement of said toy.

2. A gravity actuated walking toy as recited in claim 1 further comprising:

a) said conveyance comprising a simulated baby carriage having a handle with a simulated baby animal sitting in an upright position therein appearing to drink from a simulated baby bottle held in a generally horizontal position by hands of said baby animal, and b) the simulated animal standing in an upright position behind said simulated baby carriage holding onto the handle, and c) a second walking assembly carried in said simulated adult animal, and d) said elongated cord affixed at one end to the baby bottle.

3. A gravity actuated walking toy as recited in claim 2, wherein said first walking assembly includes:

a) a horizontal shaft affixed at each end within the underside of said simulated baby carriage, and b) a first leg member pivotally attached at its upper end to said horizontal shaft, and c) a second leg member pivotally attached at its upper end to said horizontal shaft and spaced away from said first leg member, and d) a first foot member attached to the bottom of said first leg member, and e) a second foot member attached to the bottom end of said second leg member.

4. A gravity actuated walking toy as recited in claim 3, wherein said second walking assembly unit includes:

a) a horizontal shaft affixed at each end within the body of said simulated adult animal, and b) a first leg member pivotally attached at its upper end to said horizontal shaft, and c) a second leg member pivotally attached at its upper end to said horizontal shaft and spaced away from said first leg member, and d) a first foot member attached to the bottom end of said first leg member, and e) a second foot member attached to the bottom end of said second leg member.

5. A gravity actuated walking toy as recited in claim 4, wherein said simulated toy animal is a baby panda wearing a bonnet on its head.

6. A gravity actuated walking toy as recited in claim 5, wherein said simulated animal is a female panda wearing an apron about its body.

* * * * *